US007288301B2

(12) United States Patent
Kawaguchi et al.

(10) Patent No.: US 7,288,301 B2
(45) Date of Patent: Oct. 30, 2007

(54) THERMAL RECORDING MEDIA

(75) Inventors: Takeshi Kawaguchi, Tokyo (JP); Kazuyuki Hanada, Tokyo (JP); Katsutoshi Torii, Tokyo (JP); Motoaki Umezu, Tokyo (JP); Tomoaki Kamita, Tokyo (JP)

(73) Assignees: Dainichiseika Color & Chemicals Mfg. Co., Ltd., Tokyo (JP); Ukima Colour & Chemicals Mfg. Co., Ltd., Tokyo (JP)

( * ) Notice: Subject to any disclaimer, the term of this patent is extended or adjusted under 35 U.S.C. 154(b) by 235 days.

(21) Appl. No.: 10/795,431

(22) Filed: Mar. 9, 2004

(65) Prior Publication Data

US 2004/0180152 A1 Sep. 16, 2004

(30) Foreign Application Priority Data

Mar. 13, 2003 (JP) ..... 2003-067507

(51) Int. Cl.
*B41M 5/40* (2006.01)

(52) U.S. Cl. ..... 428/32.64; 503/227

(58) Field of Classification Search .. 428/32.64–32.68; 503/200–227

See application file for complete search history.

(56) References Cited

U.S. PATENT DOCUMENTS 4,975,332 A * 12/1990 Shini et al. ..... 428/32.65

FOREIGN PATENT DOCUMENTS

| | | |
|---|---|---|
| EP | 0 324 946 | 7/1989 |
| JP | 61 227087 | 10/1986 |
| JP | 01 011888 | 1/1989 |

OTHER PUBLICATIONS

Database WPI, Section Ch, Week 199146, Derwent Publications Ltd., London, GB, Class A28, AN 1991-337168, XP002320428.

* cited by examiner

*Primary Examiner*—Bruce H. Hess
(74) *Attorney, Agent, or Firm*—Oblon, Spivak, McClelland, Maier & Neustadt, P.C.

(57) ABSTRACT

A thermal ink ribbon has a base sheet, a thermal recording layer arranged on one side of the base sheet, and a back layer arranged on an opposite side of the base sheet. The back layer according to the present invention comprises a polyurethane resin which is obtained by reacting a low molecular weight polymer having at least one active-hydrogen-containing group at one end of the molecule, a compound having at least one active-hydrogen group and at least one hydrophilic group except a hydroxide group, with a polyisocyanate. The back layer is excellent in the adhesiveness to a base sheet, the heat resistance relative to a thermal head and slipperiness to a thermal head; and the ink ribbon with such a back layer has no problems in printed characters and figures on printing, in the migration of impurities from the back layer into an ink layer, in smeariness of a thermal head and in its maintenance. Such a back layer is capable of being formed on a surface of a base sheet by only applying the coating, which comprises the above polyurethane resin, for forming a back layer; and drying the coated layer.

35 Claims, No Drawings

THERMAL RECORDING MEDIA

FIELD OF THE INVENTION

The present invention relates to thermal recording media, and more specifically to thermal recording media (hereinafter referred to as simply "ink ribbon(s)"), each of which has a back layer (a heat-resistant protecting layer) comprising a specified polyurethane resins and is useful in recording various characters and figures using a thermal printer.

DESCRIPTION OF THE BACKGROUND

A conventionally-known ink ribbon used in a thermal printer or the like has a structure having a base sheet such as a polyester film; a heat-melting-type thermal recording layer or a sublimation-type thermal recording layer on one side of the base sheet; and a back layer on the opposite side (a layer contacting with a thermal head). As materials for forming a back layer, for example, a crosslinked and hardened resin has been proposed, which resin comprises a silicone-modified polyurethane resin and polyisocyanate (see JP S61-227087 and JP S64-11888) or with an acryl-silicone graft copolymer (see JP S62-30082, JP H01-214475, and JP H02-274596). The back layer is requisite for properties that, upon the contact of a thermal head on a back layer, cause non-dropping any powder from the back layer by the contact friction; and causes non-sticking to the thermal head on the back layer in addition to appropriate slipperiness, heat resistance, and adhesiveness to the base sheet, However, the above proposed techniques are not enough ones for satisfying all the back layer's needs; and ink ribbons with a back layer of higher performance have been desirable.

An object of the present invention is, therefore, to solve the above-described problems, and provide an excellent ink ribbon having a back layer that has excellent adhesiveness to the base sheet; excellent heat resistance relative to a thermal head; good printing; no migration of impurities from a back layer into the ink layer; and no sticking to a thermal head.

The inventors of the present invention have proceeded with an extensive investigation to develop an ink ribbon overcoming the above problems; paid an attention to a phenomenon described in "The Relationship Between Phase Structure and Interface Structure Of Segmented Polyurethane Resin Introduced with Functional Groups" (Katsuhiko Nakamae, Seiji Asaoka and Sudaryanto, Journal of the Adhesion Society of Japan, Vol. 31 (No. 3), Pages 70 to 75 (1995)): For example, the phenomenon that a polyurethane resin containing sulfonic groups as side groups therein causes molecular phase separation upon the formation of a dried coating film on a substrate by using the polyurethane resin, and the sulfonic groups are internally oriented towards a surface of the substrate, but not towards externally; the inventors reached to an idea that this phenomenon is applicable to the development of an excellent ink ribbon; the use of a polyurethane resin containing sulfonic acid groups as side groups in its molecule as a material for the back layer of the ink ribbon causes increased adhesiveness of the back layer to a base sheet, because such a polyurethane resin causes molecular phase separation upon the formation of the back layer on the base sheet. As a result, the sulfonic acid groups is oriented forwards the base sheet; and the orientation results in excellent adhesiveness of the back layer to the base sheet. This idea leads to the completion of the present invention.

SUMMARY OF THE INVENTION

The above-mentioned object can be achieved by the present invention as will be described hereinafter.

In a first preferable embodiment of the present invention, there is thus provided an ink ribbon having a base sheet, a thermal recording layer arranged on one side of the base sheet, and a back layer arranged on the opposite side of the base sheet, wherein the back layer comprises, as a constituent element, a polyurethane resin which is obtained by reacting at least one kind of low-molecular weight polymer (hereinafter referred to as "compound 1") having at least one active-hydrogen-containing group at one end of the molecule, and at least one kind of compound (hereinafter referred to as "compound 2") having at least one active-hydrogen-containing group and at least one hydrophilic group except a hydroxyl group, with at least one kind of polyisocyanate (hereinafter referred to as "compound 3".); and contains at least one kind of segment and at least one segment (hereinafter referred to as "segment 1") derived from at least one kind of compound 1, at least one kind of segment and at least one segment (hereinafter referred to as "segment 2") derived from at least one kind of compound(s) 2, and at least one kind of segment and at least one segment (hereinafter referred to as "segment 3") derived from at least one kind of compound 3.

In the first preferable embodiment as described above, it is preferable that the compounds 1, 2 and 3 are reacted at an equivalent ratio of "active-hydrogen containing-groups"/"NCO", namely "the equivalent sum of all active-hydrogen-containing groups of the compounds 1 and 2"/"the equivalent sum of all NCO groups of the compound 3", of from 0.95 to 1.05; the content of the segment(s) 1 in the polyurethane resin ranges from 10 to 95 wt. % on the basis of the weight sum of all the segments excluding the segment 3; and the content of the segment(s) 2 in the polyurethane resin ranges from 0.1 to 50 wt. % on the basis of the weight sum of all the segments excluding the segment 3.

In a second preferable embodiment of the present invention, as a reacting component, at least one kind of compound selected from the group consisting of polyols and polyamines (hereinafter referred to as "compound 4") is further added in addition to at least one kind of compound 1, at least one kind of compound 2 and at least one kind of compound 3 in the reaction system of the first preferable embodiment invention; the polyurethane resin contains at least one kind of segment and at least one segment (hereinafter referred to as "segment 4") derived from at least one kind of compound 4; and the content of the segment(s) 4 in the polyurethane resin ranges from 1 to 50 wt. % on the basis of the weight sum of all the segments excluding the segment 3. In this second embodiment, the adhesiveness of a back layer to a base sheet may be controlled and adjusted dependent on application objects.

In a third preferable embodiment of the present invention, as a reacting component, at least one kind of polysiloxane compound (hereinafter referred to as "compound 5") having at least one active-hydrogen-containing group is further added in addition to at least one kind of compound, at least one kind of compound 2 and at least one kind of compound 3 in the reaction system of the first preferable embodiment of the present invention; the polyurethane resin contains at least one kind of segment and at least one segment (hereinafter referred to as "segment 5") derived from at least one kind of compound 5; the content of the segment(s) 5 in the polyurethane resin ranges from 1 to 80 wt. % on the basis of the weight sum of all the segments excluding the segment 3.

In this third embodiment, the heat resistance and slipperiness of a back layer relative to a thermal head are elevated dependent on application objects.

In a fourth preferable embodiment of the present invention, as a reacting component, at least one kind of compound 5 is further added in addition to the compounds 1, 2, 3 and 4 in the reaction system of the second preferable embodiment of the present invention; the polyurethane resin contains at least one kind of segment and at least one segment (hereinafter referred to as "segment 5") derived from the compound(s) 5; the content of the segment(s) 5 in the polyurethane resin ranges from 1 to 80 wt. % on the basis of the weight sum of all the segments excluding the segment 3. In this fourth embodiment, a back layer is endowed with the characteristics of the second and third embodiments dependent on application objects.

In each of the above preferable embodiments of the present invention, the compound 1 is a polymer represented by the following formula; and the compound 2 is at least one member selected the group consisting of dimethylol propanoic acid and dimethylol butanoic acid.

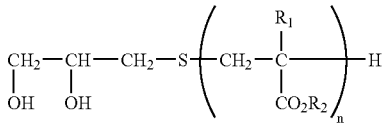

($R_1$ represents a hydrogen atom or a methyl group, $R_2$ represents an alkyl group, and n stands for an integer such that the weight average molecular weight ranges from 1,000 to 20,000.)

The polyurethane resin used in the present invention has as a whole a comb-like structure wherein at least one kind of compound 1 and at least one kind of compound 2 (and, dependent on a circumstance, in addition at least one kind of compound 4 and/or at least one kind of compound 5) constitute a backbone (main chain) by a urethane bond resulted from the reaction of those compounds with at least one kind of compound 3; at least one kind of segment 1 constitutes a side chain as a pendant on the main chain; and at least one kind of hydrophilic group (for example, a carboxyl group(s) or sulfonic acid group(s)) except a hydroxyl group(s) in the compound(s) 2 is bonded to the main chain as a side group. The compound 4 may be used preferably based on the reason as described later, and constitutes part of the main chain of the polyurethane resin, but is allowed not to be used.

The compound 5 also is preferably used in the present invention; if the compound 5 is a both ends-reactive compound, the compound constitutes the main chain of the polyurethane resin; while the compound 5, a one-end-reactive compound, constitutes a side chain(s) as a pendant on the main chain of the polyurethane resin.

Upon the formation of a dried coating film (a back layer) on the base sheet of an ink ribbon using a formulation comprising the polyurethane resin of the present invention, the segments 1 and 5 with low surface energy are externally oriented forwards the front side (the side in contact with air) of the back layer due to differences in surface energy between the segments, while the backbone (main chain) of the resin and the hydrophilic groups are internally oriented forwards a surface of the base sheet. As a result, the back layer is provided with excellent adhesiveness to the base sheet, and greater heat resistance and slipperiness relative to a thermal head.

In an ink ribbon with a conventional back layer comprising a polyurethane resin containing polysiloxane segments, the polysiloxane segments have provided the back layer with heat resistance. The polyurethane resin according to the present invention can provide a back layer with enough heat resistance even if the polyurethane does not contain any segments 5 (polysiloxane segments) That is the reason that the segments 1 have low surface energy and are externally oriented forwards the front side of the back layer. This orientation is capable of providing the back layer with greater heat resistance. Further, in the resin containing the segments 5, this further containing the segments 5 is capable of providing the back layer with additional high slipperiness as well as additional higher heat resistance.

Accordingly, the use of the above specific polyurethane resin with no segments 5 is allowable in an ink ribbon for facsimile needing a little slipperiness. In other ink ribbon needing higher slipperiness, however, the use of the polyurethane resin containing the segments 5 is more preferable. That can provide the back layer with higher heat resistance, higher adhesiveness to a basal sheet, higher abrasion resistance, and thermal head's non-smearing in addition to superb slipperiness. As a result, an excellent ink ribbon with various excellent properties is capable of being provided.

Incidentally, in a conventional back layer using the acryl-silicone graft copolymer (JP S62-30082, JP H01-214475, and JP H02-274596) as described above, macro-monomer portions containing silicone as side chains are oriented forwards the frond side (a surface exposed to air) of the back layer, while the acrylic polymer portion as a main chain is oriented forwards a surface of the base-sheet side: the silicone portions as side chains develop heat resistance, while the acrylic polymer portion as a main chain contributes to adhesiveness of the back layer to the base sheet. These characteristics are apparently different from the technical idea of the present invention.

As described above, the back layer making up the ink ribbon of the present invention is capable of being formed by only coating the surface of a base sheet with a coating or a coating formulation comprising the specified resin of the invention and drying it into a coating; the back layer is excellent in adhesiveness to the base sheet, heat resistance and slipperiness relative to a thermal head, and printed characters and figures; and the ink ribbon with the excellent back layer has no problem of migration of impurities from the back layer into the ink layer and no problem of smeariness of a thermal head upon printing because the back layer has no-tackiness to the thermal head, and in addition is excellent in the maintenance. As a result, the ink ribbon according to the present invention has an excellent back layer as above, the present invention provides, therefore, an excellent ink ribbon with various performance and functions.

DETAILED DESCRIPTION OF THE PREFERRED EMBODIMENTS

The present invention will next be described in further detail based on certain preferred embodiments.

An ink ribbon of the present invention has the thermal recording layer formed on one side of the base sheet and the back layer formed on the other side of the base sheet, and is characterized in that the polymer resin, which makes up the back layer, comprises a polyurethane resin specific to the present invention. The term "polyurethane" used herein is a general term for polyurethane, polyurea, and polyurethane-polyurea. In addition, the term "an active-hydrogen-containing group" is a group having active-hydrogen such as a hydroxyl group, mercapto group, carboxyl group and amino group which are capable of reacting with an isocyanate group.

The polyurethane resin used in the present invention is a polyurethane resin obtained by reacting the compound(s) 1 and compound(s) 2 with the compound(s) 3, if necessary, in the presence of a chain extender. Further, in the present invention, it is possible to use also a polyurethane resin obtained by adding, as a raw material component(s), the compound(s) 4 or compound 5 or both into the above raw material compounds.

The raw material components for use in producing the polyurethane resin will be described below.

[Compound 1]

The compound 1 usable in each of the preferable embodiments according to the present invention is a low-molecular weight polymer containing at least one or preferably two active-hydrogen-containing groups at an end (an end of the molecule). The glass transition temperature of the polymer is preferably 80° C. or less, and more preferably ranges from −100 to 20° C., and no limitation is imposed thereon. The compound may be made of a kind of monomer or plural kinds of monomers, and may be made of at least one kind of monomer. The compound 1 are usable in the present invention, irrespective of its kinds of constituent monomer. In general, the weight average molecular weight of the compound 1 preferably ranges from about 1,000 to 20,000 in terms of standard polystyrene by GPC.

The above compound 1 is can be obtained, for example, by polymerizing (meta)acrylic monomers using thioglycol as a chain transfer agent as represented by following formula (1) by a well-known process (for example, the bulk polymerization as described in JP 2000-128911). The above compound 1 is, however, particularly not limited by a process for preparing it.

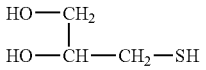

(1)

[Compound 2]

The compound 2 usable in each of the preferable embodiments according to the present invention is a compound having at least one active-hydrogen-containing group and at least one hydrophilic group such as a sulfonic group, carboxyl group, phosphoric group or amino group except a hydroxyl group. Examples of the compound 2 having a sulfonic group include the compound as described below and its derivatives.

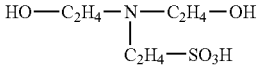

N,N-bis(2-hydroxyethyl)-2-aminoethanesulfonic acid

Further, examples of the compound 2 having a carboxyl group include dimethylol propanoic acid, dimethylol butanoic acid, low-polymerizing compounds (with the number average molecular weight of less than 500) of their alkylene oxide and/or their γ-caprolactone, half esters derived from acid anhydrides and glycerin, and compounds produced by free radical reaction of a monomer(s) having a hydroxyl group(s) and an unsaturated group(s) with a monomer(s) having a carboxyl group(s) and an unsaturated group(s).

The aforementioned compounds are preferable examples of the compounds 1 and 2 usable in the present invention, and the compounds land 2 shall be not limited to these exemplified ones. In the present invention, it is therefore, possible to use not only the exemplified compounds but also other known compounds currently sold on the market and easily available from the market.

[Compound 3]

As the compound 3 usable in each of the preferable embodiments according to the present invention, any compounds utilizable for producing well-known polyurethane resins by conventional methods can be used and no particular limitation is imposed thereon. Preferable examples include aromatic diisocyanates such as toluene-2,4-diisocyanate, 4-methoxy-1,3-phenylene diisocyanate, 4-isopropyl-1,3-phenylene diisocyanate, 4-chloro-1,3-phenylene diisocyanate, 4-butoxy-1,3-phenylene diisocyanate, 2,4-diisocyanatodiphenyl ether, 4,4'-methylenebis(phenyleneisocyanate) (MDI), durylene diisocyanate, tolidine diisocyanate, xylylene diisocyanate (XDI), 1,5-naphthalene diisocyanate, benzidine diisocyanate, o-nitrobenzidine diisocyanate, and 4,4-diisocyanatodibenzyl; aliphatic diisocyanates such as methylene diisocyanate, 1,4-tetramethylene diisocyanate, 1,6-hexamethylene diisocyanate, and 1,10-decamethylene diisocyanate; alicyclic diisocyanates such as 1,4-cyclohexylene diisocyanate, 4,4'-methylene-bis(cyclohexylisocyanate), 1,5-tetrahydronaphthalene diisocyanate, isophorone diisocyanate, hydrogenated MDI, and hydrogenated XDI. In addition, it is naturally possible to use polyurethane prepolymers obtained by reacting these diisocyanates with polyols or polyamines of low molecular weights so that the resulting prepolymers have isocyanate groups at ends thereof.

[Compound 4]

The compound 4 is used in the second preferable embodiments according to the present invention; the compound can adjust and control the adhesiveness of a back layer to a base sheet.

As low-molecular polyols, ones of the compound 4, it is possible to use all conventionally-known polyols such as low-molecular diols and macromolecular polyols which have been conventionally used to date for producing polyurethane resins. As polyamines, ones of the compound 4 usable in the second preferable embodiments according to the present invention, it is possible to use all low-molecular diamines which have been conventionally used for producing polyurethane resins. No particular limitation are imposed thereon.

Examples of low-molecular diols include aliphatic glycols such as ethylene glycol, 1,2-propylene glycol, 1,3-propylene glycol, 1,4-butylene glycol, 1,6-hexamethylene glycol, and neopentyl glycol and low-polymerizing compounds (with the number average molecular weight of less than 500) of their alkylene oxides; alicyclic glycols such as 1,4-bishydroxymethylcyclohexane, 2-methyl-1,1-cyclohexadimethanol and low-polymerized compounds (with the number average molecular weight of less than 500) of their alkylene oxides; aromatic glycols such as xylylene glycol and low-polymerized compounds (with the number average molecular weight of less than 500) of their alkylene oxides; bisphenols such as bisphenol A, thiobisphenol, sulfonebisphenol and low-polymerized compounds (with the number average molecular weight of less than 500) of their alkylene oxides; and alkyl dialkanolamine such as alkyl diethanolamine of $C_1$ to $C_{18}$.

Illustrative of the low molecular polyols are polyalcohols such as glycerin, trimethylol ethane, trimethylol propane, pentaerythritol, tris-(2-hydroxyethyl)isocyanurate, 1,1,1-trimethylol ethane, and 1,1,1-trimethylol propane. These maybe used alone or in a combination of at least two compounds.

Examples of high molecular polyols include compounds as described below:

(1) Polyether polyols, for example, obtained from polymerization or copolymerization of alkylene oxides (such as ethylene oxide, propylene oxide and butylene oxide) and heterocyclic ethers (such as tetrahydrofuran) Concrete examples of the polyether polyols include polyethylene glycol, polypropylene glycol, polyethylene glycol-polytetramethylene glycol (block or random), polytetramethylene ether glycol, ployhexamethylene glycol and the like.

(2) Polyester polyols, for example, obtained from condensation polymerization of aliphatic dicarboxylic acids (such as, for example, succinic acid, adipic acid, sebacic acid, glutaric acid, and azelaic acid) and/or aromatic dicarboxylic acids (such as, for example, isophthalic acid and terephthalic acid), and low-molecular weight glycols (such as, for example, ethylene glycol, 1,2-propylene glycol, 1,3-propylene glycol, 1,4-butylene glycol, 1,6-hexamethylene glycol, neopentyl glycol, and 1,4-bishydroxymethylcyclohexane) Concrete examples of the polyester polyols include polyethylene adipate diol, polybutylene adipate diol, polyhexamethylene adipate diol, polyneopentyl adipate diol, polyethylene/butylene adipate diol, polyneopentyl/hexyl adipate diol, poly-3-methylpentane adipate diol, polybutylene isophthalate diol, and the like.

(3) Polylactone polyols such as, for example, polycaprolactone diol, polycaprolactone triol, poly-3-methylvalerolactone diol, and the like.

(4) Polycarbonate diols such as, for example, polyhexamethylene carbonate, and the like.

(5) Polyolefin polyols such as, for example, polybutadien glycol, polyisoprene glycol and their hydrogenated compounds, and the like.

(6) Polymethacrylate diols such as, for example, α,ω-polymethylmethacrylate diol, α,ω-polybutylmethacrylate diol, and the like.

The molecular weights of these polyols are not limited particularly, but generally, the number average molecular weight ranges from about 500 to 2,000. The polyols can be used alone or in a combination of at least two polyols.

Illustrative of the polyamines are polyamines such as low-molecular diamines, aliphatic diamines, aromatic diamines and hydrazines. Examples of low-molecular diamines include aliphatic diamines such as methylenediamine, ethylenediamine, trimethylenediamine, hexamethylenediamine and octamethylenediamine; aromatic diamines such as phenylenediamine, 3,3'-dichloro-4,4'-diaminodiphenyl methane, 4,4'-methylenebis(phenylamine), 4,4'-diaminodiphenyl ether, and 4,4'-diaminodiphenyl sulfone; and alicyclic diamines such as cyclopentadiamine, cyclohexyldiamine, 4,4'-diaminodicyclohexylmethane, 1,4-diaminocyclohexane and isophoronediamine. Examples of hydrazines include hydrazine, carbodihydrazide, adipic dihydrazide, sebacic dihydrazide, and phthalic dihydrazide. These compounds can be used alone or in a combination of at least two compounds. Preferable as polyol and polyamine are diol and diamine respectively.

[Compound 5]

The compound 5 is used in the third and fourth preferable embodiments; the use of the compound can provide a back layer with the heat resistance and slipperiness relative to a thermal head.

Examples usable as the compound 5 in the present invention dependent on needs include compounds as described below:

(1) Amino-modified polysiloxane

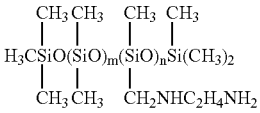

(m = 1~200, n = 2~200)

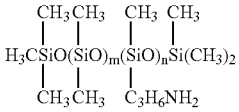

(m = 1~200, n = 2~200)

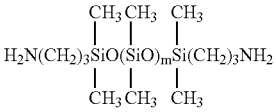

(m = 1~300)

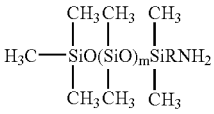

(m = 1~300, R = lower alkylene group)

(2) Epoxy-modified polysiloxane (which is used by opening an epoxy ring)

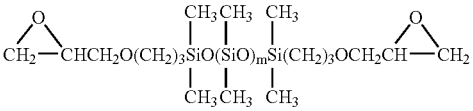

(m = 1~300)

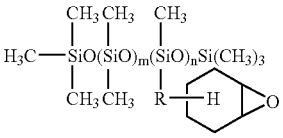

(m = 1~200, n = 2~200, R = lower alkylene group)

-continued

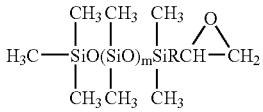

(m = 1~300, R = lower alkylene group)

(3) Alcohol-modified polysiloxane

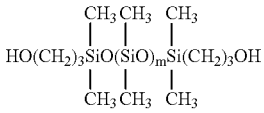

(m = 1~300)

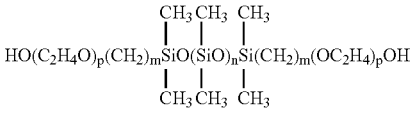

(p = 1~300, m = 2~6, n = 1~300)

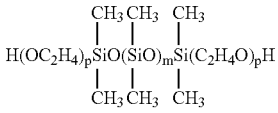

(p = 1~300, m = 1~300)

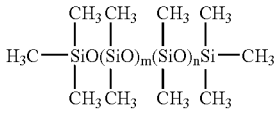

(m = 1~200, n = 2~200, R = lower alkylene group)

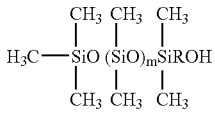

(m = 1~300, R = lower alkylene group)

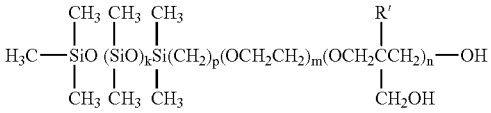

(k = 1~300, p = 0~5, m = 0~50, n = 1~3, R′ = H or alkyl group)

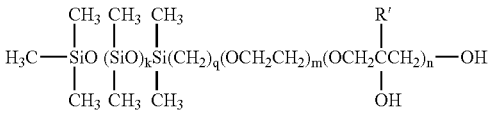

(k = 1~300, q = 0~5, m = 0~50, n = 1~3, R′ = H or alkyl group)

(4) Mercapto-modified polysiloxane

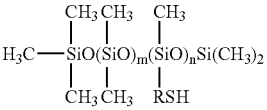

(m = 1~200, n = 2~200, R = lower alkylene group)

-continued

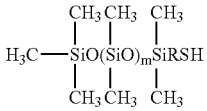

(m = 1~300, R = lower alkylene group)

Examples of the compound 5 as described above are preferably usable in the present invention, and no particular limitation is imposed on these illustrative compounds. Accordingly, other compounds, which are currently sold on the market and easily available from the market, may be all used in the present invention as well as the illustrative compounds as described above.

The compounds 5 most preferably usable in the present invention are polysiloxanes having two hydroxyl groups or two amino groups.

[Production of Polyurethane Resin]

No particular limitation is imposed on the methods for producing a polyurethane resin by using above-mentioned raw material compounds. Conventionally-known methods for producing a polyurethane resin are all usable in the present invention. Illustrative methods will be indicated hereinafter.

The method according to the first preferable embodiment is characterized in that, in the presence of an organic solvent containing no active-hydrogen in its molecule or in no presence of such a solvent, if necessary, using a chain extender such as a low-molecular diol or low-molecular diamine, at least one kind of compound 1 and at least one kind of compound 2 as described above are reacted with at one kind of compound 3 as described above in a molecular ratio such that an equivalent ratio of an equivalent sum of active-hydrogen-containing groups relative to an equivalent sum of isocyanate groups (this reaction: "the equivalent sum of all active-hydrogen-containing groups of the compounds 1 and 2"/"the equivalent sum of all NCO groups of the compound 3") generally ranges from 0.95 to 1.05 and is preferably 1.0; the reaction is performed at temperature generally ranging from 20 to 150° C. or preferably from 60 to 110° C. by an one-shot method or an multi-stage method until the isocyanate groups are hardly detected. The polyurethane resin usable for the present invention can thereby be obtained. The obtained polyurethane resin contains at least one kind of segment 1, at least one kind of segment 2 and at least one kind of segment 3.

The method according to the second preferable embodiment is characterized in that the compound 4 is used in the reaction system and reaction conditions of the first preferable embodiment in addition to the compounds 1, 2 and 3 as described above. The obtained polyurethane resin contains at least one kind of segment 4 in addition to the above segments 1, 2 and 3.

The method according to the third preferable embodiment is characterized in that the compound 5 is used in the reaction system and reaction conditions of the first preferable embodiment in addition to the compounds 1, 2 and 3 as described above. The obtained polyurethane resin contains at least one kind of segment 5 in addition to the above segments 1, 2 and 3.

The method according to the fourth preferable embodiment is characterized in that the compound 5 is used in the reaction system and reaction conditions of the second preferable embodiment in addition to the compounds 1, 2, 3 and 4 as described above. The obtained polyurethane resin contains at least one kind of segment 5 in addition to the above segments 1, 2, 3 and 4.

Incidentally, in the second, third and fourth preferable embodiments, the reaction for synthesis of a polyurethane resin is performed in an similar equivalent ratio of the equivalent sum of active-hydrogen groups relative to the equivalent sum of NCO groups as that of the first embodiment.

In addition, the polyurethane resin usable for each of the preferable embodiments according to the present invention may be synthesized using any organic solvent or non-using. Preferably illustrative of the organic solvents are methyl ethyl ketone, methyl-n-propyl ketone, methyl isobutyl ketone, diethyl ketone, methyl formate, ethyl formate, propyl formate, methyl acetate, ethyl acetate and butyl acetate. Further it is possible to use acetone, cyclohexane, tetrahydrofuran, dioxane, methanol, ethanol, isopropyl alcohol, butanol, toluene, xylene, dimethylformamide, dimethyl sulfoxide, perchloroethylene, trichloroethylene, methyl cellosolve, butyl cellosolve, and cellosolve acetate.

In the production of the polyurethane resin for use in the first preferable embodiments according to the present invention, a usage amount of the compound 1 may be in a range of 10 to 95 wt. % on the basis of the weight sum of the compounds 1 and 2 and preferably in a range of 30 to 90 wt. %. A usage amount of compound 2 may be in a range of 0.1 to 50 wt. % on the basis of the weight sum of the compounds 1 and 2 and preferably in a range of 0.5 to 25 wt. %. In the production of the polyurethane resin for use in the second preferable embodiments according to the present invention, the compound 4 may be capable of being used in a usage amount with a range of 1 to 50 wt. % on the basis of the weight sum of the compounds 1, 2 an 4, with a preferable range of 3 to 10 wt. %. In the production of the polyurethane resin for use in the third preferable embodiments according to the present invention, the compound 5 may be capable of being used in a usage amount with a range of 1 to 80 wt. % on the basis of the weight sum of the compounds 1, 2 an 5, with a preferable range of 3 to 50 wt. %. In the production of the polyurethane resin for use in the fourth preferable embodiments according to the present invention, the compound 5 may be capable of being used in a usage amount with a range of 1 to 80 wt. % on the basis of the weight sum of the compounds 1, 2, 4 and 5, with a preferable range of 3 to 50 wt. %. Any of the above preferable embodiments is selected depending upon its purpose.

Incidentally, the compound 4 may be used with the aim of adjusting the viscosity of the solution containing the polyurethane resin according to the present invention, the adhesiveness of the back layer to the base sheet, and the like, although the compound 4 is permitted not to be used depending upon its purpose. The compounds 1 to 5 do not change in those mass (weight) during the synthesis of the polyurethane resin; thus, the amounts (wt. %) of the segments 1 to 5 existing in the polyurethane resin are respectively the same as those amounts used as raw materials in the synthesis. The weight average molecular weight of the polyurethane resin as described above may, therefore, be preferably in a range of 10,000 to 500,000 (as measured by GPC and calibrated against standard polystyrene).

If the compounds as raw materials except for the compound 3 have more preferably all two active-hydrogen-containing groups (incidentally, if the compound 1 is a compound bonded with the compound of the above mentioned formula 1 at one end of the polymer) and the compound 3 is a diisocyanate, the polyurethane resin having no segment 5 and another polyurethane resin having the segment 5 are represented by the following general formulas (2) and (3) respectively.

The units of from A to E in each general formula are indicated by the following. Each of from "a" to "e" indicates the content ratio of each unit, and each of the content ratio is calculated on the basis of a usage amount of each of the above compounds of the unit and an amount of (a) diisocyanate(s) reacted with each of those.

A unit: Unit derived from the compound 2

B unit: Unit derived from the compound 1

C unit: Unit derived from the compound 4

D and E units: Units derived from the compound 5

Polyurethane resin having no segments 5

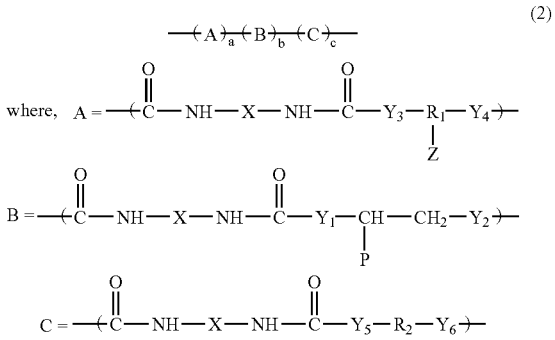

(2)

Polyurethane resin with the segments 5

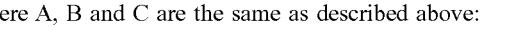

(3)

where A, B and C are the same as described above:

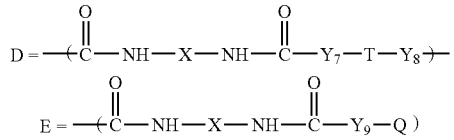

In each of aforementioned formulas, the P represents a kind of the segment 1 with the weight average molecular weight ranging from about 1,000 to 20,000. The T and Q represent a kind of segment 5 respectively and may be the same kind or different kind from each other; those weight average molecular weights may range from about 500 to 20,000; $R_1$ represents a trivalent organic group and the group may contain at least one atom of O, N and S as a bonding group; $R_2$ represents a divalent organic group and the group may contain at least one atom of O, N and S as a bonding group; the X represents a divalent hydrocarbon radical and the radical may be aliphatic, aromatic or alicyclic and may have at least one atom of O, N and S as a bonding group; the $Y_1$ to $Y_9$ represents —O— or —NH— and may be the same or different from another; and the Z represents —COOH, —$SO_3H$, —$P(OH)_2$, —$NH_2$ or their salt and may be bonded directly to $R_1$ or via an organic group.

Each of the "a" to "e" means a content ratio of an each unit. In a comb-like polyurethane resin containing hydrophilic groups, The "a" means a range of from 0.1 to 50 wt. % content and preferably from 0.5 to 25 wt. % content. The "b" means a range from 10 to 95 wt. % content and preferably from 30 to 90 wt. % content. The "c" means a range from 0 to 50 wt. % content and preferably from 3 to 10 wt. % content (incidentally, the total of the "a" to "c" is 100 wt. % content). In a polyurethane resin containing the segment 5, the "a" to "c" has the same meanings as those in the foregoing respectively. The "d+e" ranges from 1 to 80 wt. % content and preferably from 3 to 50 wt. % content (incidentally, either of "d" and "e" may be 0 wt. % content and the total content of the "a" to "e" is 100 wt. % content).

The T in the unit D and the Q in the unit E in the above general formula (3) represent a kind of the segment 5, respectively. The T is a segment derived from a compound having two active-hydrogen-containing groups; the Q is a segment derived from a compound having one active-hydrogen-containing group; those are capable of been obviously understood based on the structural formulas D and E. As also is apparent from the above formulas, the T is a kind of segment 5 having an alkylene group (including an alkylene group containing at least one atom of O, S and N as a boding group) bonded at one end and another end of a dimethylsiloxane chain, respectively. The Q is a kind of segment 5 having an alkylene group (including an alkylene group containing at least one atom of O, S and N as a boding group) bonded to a Si atom of one end of a dimethylsiloxane chain or to a Si atom within the chain.

[The Formation of a Back Layer]

A back layer of the ink ribbon according to the present invention can be made mainly up of the polyurethane resin as described above, and, depending upon its application purpose, it is possible to use at least one member selected from the group consisting of a cross-linking agent(s), another binder resin(s), wax, and the like.

As the wax usable for the present invention, any conventionally-known waxes may be used, those having the weight average molecular weight ranging from 250 to 10,000, and no particular limitation is imposed thereon. Examples of the wax include natural waxes such as Candelilla wax, Carnauba wax, rice wax, wood wax, honey wax, lanolin, whale wax, Montan wax, ozokelite and ceresin; petroleum wax such as paraffin wax, microcrystalline wax, petrolactam and modified waxes such as derivatives from these waxes; hydrogenated waxes such as hardened castor oil and its derivatives; synthetic hydrocarbons such as Fischer-Tropsch wax, polyester wax, and chlorinated hydrocarbons; and synthetic fatty acid derivatives such as 12-hydroxystearic acid, stearic amide and phthalic anhydride imide.

The above wax may be used alone or in a combination of at least two kinds of wax. The polyurethane resin containing the wax according to the present invention can be endowed with additional heat resistance, blocking resistance and slipperiness. The content of the wax in the polyurethane resin is 95 wt. % or less on the basis of solid content and preferably is in a range of from 3 to 30 wt. %, and no particular limitation is imposed thereon.

The back layer according to the present invention may be crosslinked to the base sheet. As the method for crosslinking, it may be possible to use a method utilizing the reactivity of an urethane bond or of a hydrophilic group such as a carboxyl group or of both and no limitation is imposed thereon.

In the crosslinking method utilizing a urethane bond, for example, there is a method utilizing a polyisocyanate crosslinking agent. As the polyisocyanate crosslinking agent, conventionally-used agents may be all used, and no particular limitation is imposed thereon. Usable examples of the agents include a dimer of 2,4-tolylene diisocyanate, triphenylmethane triisocyanate, tris-(p-isocyanatephenyl) thiophosphite, aromatic polyisocyanate, aromatic-aliphatic polyisocyanate, aliphatic polyisocyanate, fatty acid modified aliphatic polyisocyanate, blocked polyisocyanates such as blocked aliphatic polyisocyanate, and polyisocyanate prepolymer.

These polyisocyanate crosslinking agents are particularly effective in additionally-improvement of the heat resistance of the back layer and the prevention of the migration of impurities from the back layer into an ink layer, if the amounts for use are suitable. However, in the use of the excessive amounts, unreacted crosslinking agents remain in the back layer and its remaining agents causes disadvantages such as reduced heat resistance of the back layer and migration of impurities from a back layer into an ink layer in an ink ribbon. A suitable amount of the agent for use is 120 wt. parts or less on the basis of 100 wt. parts of the polyurethane resin and preferably in a range of 0.5 to 80 wt. parts.

In the crosslinking method utilizing a hydrophilic group such as a carboxyl group, conventionally-known agents may be all used. These examples include an epoxy crosslinking agent, a carbodiimide crosslinking agent and a metal complex crosslinking agent, and no particular limitation is imposed on these examples. As the epoxy crosslinking agent, for example, commercially available well-known epoxy resins can be used such as "Epicoat" (a trade name, a product of Yuka Shell Epoxy Co., Ltd.). Further, as the carbodiimide crosslinking agent, "Carbodilite" (a trade name, a product of Nisshinbo Industries, Inc.), which is commercially available, can be used.

As the metal complex crosslinking agent, commercial available agents can be all used such as titan organic compounds, zirconium organic compounds and acetylacetone complexes of metals. For example, a zirconium organic compound with a trade name of "Orgatix" (a product of Matsumoto Chemical Industry Co., Ltd.) is available on market. It may be possible to use commercially-available acetylacetone complexes of metals such as those of aluminum, chrome, cobalt, copper, iron, nickel, vanadium, zinc, indium, calcium, magnesium, manganese, yttrium, cerium, strontium, palladium, barium, molybdenum, lanthanum, and tin. For example, the tin acetylacetone complex with a trade name of "Nasemu" (a product of Nihon Kagaku Sangyo Co., Ltd.) is on the market. These crosslinking agents of suitable amounts are particularly effective in additional improvement of heat resistance of the back layer and of prevention of the migration of the impurities as described above in an ink ribbon. However, the utilization of the agents of excessive amounts causes the extreme reduction of usable life of a back layer-forming coating and the embrittlement of a formed back layer. The amount suitable for use is 40 wt. parts or less on the basis of 100 wt. parts of the polyurethane resin, and preferably in a range of 0.5 to 10 wt. parts.

No particular limitation is imposed on binder resins use for the present invention except for the polyurethane resin. Examples of the binder resins include conventionally-known resins such as silicone resin, polyester resin, polyamide resin, polyimide resin, polystyrene resin, polyurethane resin, polycarbonate resin, norbornene resin, cellulose resin, polyvinyl alcohol resin, polyvinyl formal resin, polyvinyl butyral resin, polyvinylpyrrolidone resin, polyvinyl acetate resin, and polyvinyl acetal resin. Usable amounts of these resins are generally 900 wt. parts or less on the basis of 100 wt. parts of the polyurethane resin, and preferably in a range of 5 to 400 wt. parts. No limitation is, however, particularly imposed on thereon.

If necessary, an antistatic agent, organic fine particles, inorganic fine particles, and other additives may be further used as a constituent of the back layer according to the present invention. Usable examples of the organic fine particles and inorganic fine particles include silicone resin fine particles, fluorine resin fine particles, acrylic resin fine particles, urethane resin fine particles, polyethylene resin fine particles, and reactive siloxane. Usable examples of the antistatic agents include carbon black; metal oxides such as tin oxide and titan oxide; metal alkoxides; conductive fillers such as ITO powder; organic conductives such as polyaniline, polythiophene, and polypyrrole; and surfactants such as modified ethylene oxide.

In the formation of the back layer of the ink ribbon according to the present invention, a back layer-forming coating or a coating formulation can be used, which coating or coating formulation comprises the polyurethane resin as described above as a film-forming component. The coating may be adjusted without a solvent or with an organic solvent. Examples preferable as the organic solvent include methyl ethyl ketone, methyl-n-propyl ketone, methyl isobutyl ketone, diethyl ketone, methyl formate, ethyl formate, propyl formate, methyl acetate, ethyl acetate and butyl acetate. Further usable examples include acetone, cyclohexane, tetrahydrofuran, dioxane, methanol, ethanol, isopropyl alcohol, butanol, toluene, xylene, dimethylformamide, dimethyl sulfoxide, perchloroethylene, trichloroethylene, methyl cellosolve, butyl cellosolve, and cellosolve acetate. A solid content of a coating or a coating formulation adjusted by using an organic solvent is not limited particularly, but generally ranges from about 3 to 95 wt. % on the basis of weight coating.

The ink ribbon according to the present invention can be prepared by conventionally-known methods using a back layer-forming coating, and no particular limitation is imposed on the method itself for preparing the ink ribbon. Further, as materials for a base sheet and a thermal recording layer (ink layer) excluding the back layer, materials having been conventionally utilized may be all usable, and the materials are not limited particularly.

In forming a back layer of the ink ribbon of the present invention, the back layer is formed by applying a back layer-forming coating comprising the polyurethane resin as descried above on a surface of the back side of a base sheet (is the front side; the side opposite to the base sheet's side with the thermal recording layer) by a conventionally-known means so that the back layer is about 0.01 to 1 μm in dry thickness.

The present invention will be described more specifically hereinafter with reference to production examples, examples and comparative examples, but is not limited to such examples. In addition, all designations of "part" or "parts" and "%" are on the basis of weight unless otherwise specifically indicated.

EXAMPLE

Examples 1 to 8 and Comparative Examples 1 to 3

The atmosphere of a reaction vessel equipped with a stirrer, a reflux condenser, a thermometer, a nitrogen gas inlet tube and a manhole was replaced with nitrogen gas, and then predetermined amounts of the compounds 1, 2, 4 and 5, a chain extender (6) and the solvents seen in Tables 1 and 2 were added in the vessel; the mixture was stirred uniformly so that the constituents were all solubilized; the sum concentration of the constituents excluding the solvents in the mixture was adjusted by adding the solvents to become 30 wt. %. Then, a predetermined amount of the compound 3 was added so that the equivalent ratio (the equivalent sum of active-hydrogen-containing groups/the equivalent sum of the NCO groups) became 1 (one), and the reaction was carried out at 80° C. until the infrared absorption spectrum due to a free isocyanate group was not detected at 2,270 cm⁻1. Tables 1 and 2 show compositions of raw materials and additives for synthesizing polyurethane resins and properties of the obtained polyurethane resins (PU).

TABLE 1

| | | Example 1 | Example 2 | Example 3 | Example 4 | Example 5 |
|---|---|---|---|---|---|---|
| Raw-medium compositions | Compound 1 | A-1 | A-1 | A-1 | A-2 | A-3 |
| | Compound 2 | B-1 | B-1 | B-2 | B-1 | B-1 |
| | Compound 4 | PCD | PCD | PCD | PCD | PCD |
| | Compound 5 | — | D-1 | D-1 | D-1 | D-1 |
| | Chain extender (6) | 1,4-BD | 1,4-BD | 1,4-BD | 1,4-BD | 1,4-BD |
| | Parts (1/2/4/5/6) | 80/5/10/0/5 | 60/5/10/20/5 | 60/5/10/20/5 | 60/5/10/20/5 | 60/5/10/20/5 |
| | Compound 3 | Hexamethylene diisocyanate | | | | |
| | Organic solvent (anon/MEK) | 1/1 | 1/1 | 1/1 | 1/1 | 1/1 |
| Properties of PU | Weight average m.w. | 50,000 | 55,000 | 55,000 | 55,000 | 55,000 |
| | Carboxyl group content (meq/g) | 0.30 | 0.31 | 0.28 | 0.31 | 0.31 |
| | Segment 1 content (%) | 65 | 49 | 49 | 49 | 49 |
| | Segment 5 content (%) | 0 | 16 | 16 | 16 | 16 |
| Properties of coating | Appearance | Pale yellow liquid | Pale yellow liquid | Pale yellow liquid | Pale yellow liquid | Pale yellow liquid |
| | Solid content (%) | 20 | 20 | 20 | 20 | 20 |
| | Viscosity (mPa · S, 20° C.) | 25 | 30 | 30 | 30 | 30 |

TABLE 1-continued

| | | Example 1 | Example 2 | Example 3 | Example 4 | Example 5 |
|---|---|---|---|---|---|---|
| Others | Crosslinking agent (phr) | — | — | — | — | — |
| | Aging | Not needed | Not needed | Not needed | Not needed | Not needed |

TABLE 2

| | | Example | | | Comparative Example | | |
|---|---|---|---|---|---|---|---|
| | | 6 | 7 | 8 | 1 | 2 | 3 |
| Raw-medium compositions | Compound 1 | A-4 | A-1 | A-1 | — | A-1 | — |
| | Compound 2 | B-1 | B-1 | B-1 | B-1 | — | — |
| | Compound 4 | PCD | PCD | — | PCD | PCD | PCD |
| | Compound 5 | D-1 | D-1 | D-1 | D-1 | D-1 | D-1 |
| | Chain extender (6) | 1,4-BD | 1,4-BD | 1,4-BD | 1,4-BD | 1,4-BD | 1,4-BD |
| | Parts (1/2/4/5/6) | 60/5/10/20/5 | 60/5/10/20/5 | 70/5/0/20/5 | 0/5/70/20/5 | 60/0/10/20/10 | 0/0/70/10/20/10 |
| | Compound 3 | Hexamethylene diisocyanate | | | | | |
| | Organic solvent (anon/MEK) | 1/1 | 1/1 | 1/1 | 1/1 | 1/1 | 1/1 |
| Properties of PU | Weight average m.w. | 55,000 | 55,000 | 55,000 | 55,000 | 55,000 | 70,000 |
| | Carboxyl group content (meq/g) | 0.31 | 0.31 | 0.31 | 0.31 | 0 | 0 |
| | Segment 1 content (%) | 49 | 49 | 57 | 0 | 48 | 0 |
| | segment 5 content (%) | 16 | 16 | 16 | 16 | 16 | 16 |
| Properties of Coatings | Appearance | Pale yellow liquid | Pale yellow liquid | Pale yellow liquid | Pale yellow liquid | Pale yellow liquid | Pale yellow liquid |
| | Solid content (%) | 20 | 20 | 20 | 20 | 20 | 20 |
| | Viscosity (mPa · S, 20° C.) | 30 | 30 | 25 | 100 | 130 | 150 |
| Others | Crosslinking agent (phr) | — | 20 | — | — | — | 20 |
| | Aging | Not needed | Needed | Not needed | Not needed | Not needed | Needed |

In addition, symbols seen in Table 1 and Table 2 represent as described below:

[Compound 1]

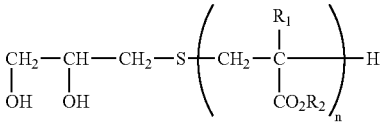

A-1: R=ethyl group; the weight average m.w.=2,000; Tg=−24° C.

A-2: R=n-butyl group; weight average m.w.=2,000; Tg=−54° C.

A-3: R=isobutyl group; weight average m.w.=2,000; Tg=−31° C.

A-4: R=2-ethylhexyl group; weight average m.w.=2,000; Tg=−85° C.

n: an integer such as that a weight average m.w. becomes above values.

[Compound 2]
B-1:dimethylol propanoic acid
B-2:dimethylol butanoic acid

[Compound 4]
PCD: Polycarbonate diol (a product of Daicel Chemical Industries, Ltd.; a trade name, Placcel CD220; a number average molecular weight, 2,000)

[Compound 5]
D-1: Polysiloxane diol (a product of Shin-Etsu Chemical Co., Ltd.; a trade name, KF-6003; a weight average molecular weight, 5,100

[Chain Extender (6)]
1,4-BD: 1,4-butanediol

[Organic Solvent]
Anon: Cyclohexanone
MEK: Methyl ethyl ketone

[Crosslinking Agent]

Multifunctional aromatic isocyanate (a product of Sumitomo Bayer Ltd.; a trade name, Sumidur L)

Samples for a back layer-forming coating, which samples were prepared in each of the above Examples and Comparative Examples, were applied by gravure printing onto a surface of polyethylene terephthalate film of 6 μm in thickness (a product of Toray Industries, Inc.) to give layers of 0.1 μm in dried thickness; the solvents of the layers were evaporated by using a drier; and thus the back layers were formed. In the coating samples of Example 7 and Comparative Example 3, after each of those had been applied on the film and the layer dried, each layer on the film was aged in an oven at 40° C. for 72 hours; and every back layers were finally thus formed.

A transfer ink composition for an ink ribbon was prepared in the formula as described below. The ink composition was heated at 100° C. and applied by using a hot-melt roll coating method on a surface of the base sheet of PET, said surface being located on a side opposite to the back layer formed as described above; the ink layer was formed so as to be 5 μm in coating thickness; and in this manner, the ink ribbons of Examples and Comparative Examples were prepared.

[Transfer Ink Composition]

| | |
|---|---|
| Paraffin Wax | 10 parts |
| Carnauba wax | 10 parts |
| Polybutene (manufactured by Shin Nippon Oil Corporation) | 1 part |
| Carbon Black | 2 parts |

(manufactured by Shin Nippon Oil Corporation)

Using each of the ink ribbons prepared as described above, printing was carried out by using a thin-film thermal head under the conditions of printing energy of 1 mJ/dot ($4\times10^{-}4/cm^2$). In the course of the printing, the following problems were examined, measured and evaluated: the stickiness of back layers thermal heads (sticking tendency); the smeariness of thermal heads (head smearing tendency); the adhesion (adhesiveness) of the back layers to the PET film (adhesion); and the migration of impurities from the back layers into the ink layers (impurities-migrating tendency). Each evaluation method was described below. Table 3 shows these evaluation results.

(1) Sticking Tendency

The following subjects were visually evaluated and was ranked in accordance with a three-stage ranking stage: an occurred wrinkle in an ink ribbon upon pressing the thermal head against the ink ribbon when the ink ribbon was subjected to an on-machine test; occurred sticking of the thermal head to the back layer, and heat-fusion of the thermal head with the ink ribbon: An ink ribbon with no sticking receiving "A"; An ink ribbon with a few wrinkles receiving "B"; and an ink ribbon with running-inability of the thermal head due to breaking of the ink ribbon receiving "C".

(2) The Head Smearing Tendency

The extent of smearing of a thermal element's portion of the thermal head was visually evaluated in accordance with a two-stage ranking stage system when the ink ribbon was subjected to an on-machine test: A thermal element's portion with no smear receiving "A"; a thermal element's portion with smear receiving "B".

(3) Adhesion (Adhesiveness)

The adhesion of a back layer to a base sheet was evaluated by a crosshatching test using a cellophane tape.

(4) Impurities-Migrating Tendency (Abbreviated Simply in Terms of "Impurities" in Table 3)

The ink ribbon wound in the form of a roll was left in an oven at 40° C. for three days, and then, the degree of migration of low-molecular polysiloxane, ethylene wax or the like of the back layer to the ink layer was evaluated by a touching method using a finger and a visual method, being ranked by "A" in no occurred migration, and being ranked by "B" in the occurred migration.

TABLE 3

| | Example No. | | | | | | | | Comparative Example No. | | |
|---|---|---|---|---|---|---|---|---|---|---|---|
| | 1 | 2 | 3 | 4 | 5 | 6 | 7 | 8 | 1 | 2 | 3 |
| Sticking tendency | A | A | A | A | A | A | A | A | C | C | A |
| Head smearing tendency | A | A | A | A | A | A | A | A | B | B | B |
| Adhesion | 100/100 | 100/100 | 100/100 | 100/100 | 100/100 | 100/100 | 100/100 | 100/100 | 100/100 | 100/100 | 100/100 |
| Impurities | A | A | A | A | A | A | A | A | A | A | A |

As described above, the ink ribbon according to the present invention is an ink ribbon with a back layer excellent in adhesiveness to a base sheet, heat resistance relative to a thermal head and slipperiness to a thermal head; and the resultant ink ribbon with the excellent back layer according to the present invention has no problems in printed characters and figures on printing, in the migration of impurities from the back layer into an ink layer, in smeariness of a thermal head and in its maintenance; and such a back layer is capable of being formed on a surface of a base sheet by only applying a coating on the surface of the base sheet, which coating comprises a specific polyurethane resin according to the present invention; and drying the formed layer.

What is claimed is:

1. A thermal recording medium comprising a base sheet, a thermal recording layer provided on one side of the base sheet, and a back layer arranged on the opposite side of the base sheet, wherein the back layer comprises as a coating film-forming component a polyurethane resin which is obtained by reacting at least one kind of low-molecular weight polymer (hereinafter referred to as "compound 1") having at least one active-hydrogen-containing group at one end of the molecule, and at least one kind of compound (hereinafter referred to as "compound 2") having at least one active-hydrogen-containing group and at least one hydrophilic group except a hydroxyl group, with at least one kind of polyisocyanate (hereinafter referred to as "compound 3");

wherein at least one segment (hereinafter referred to as "segment 1") is derived from at least one kind of compound 1, at least one another segment (hereinafter referred to as "segment 2") derived from at least one kind of compound 2, and at least one further another segment (hereinafter referred to as "segment 3") derived from at least one kind of compound 3; and wherein at least one kind of polysiloxane compound (hereinafter referred to as "compound 5") having at least one active-hydrogen-containing group is further used as a reacting-component in addition to at least one kind of compound 1, at least one kind of compound 2 and at least one kind of compound 3; and the polyurethane resin comprises at least one segment (hereinafter referred to as "segment 5") derived from at least one kind of compound 5.

2. The thermal recording medium according to claim 1, wherein at least one kind of compound 1, at least one kind of compound 2 and at least one kind of compound 3 are reacted at an equivalent ratio of "the equivalent sum of all active-hydrogen-containing groups of the compound 1 and compound 2"/"the equivalent sum of all NCO groups of the compound 3" of from 0.95 to 1.05.

3. The thermal recording medium according to claim 1, wherein a content of the segment 1 in the polyurethane resin ranges from 10 to 95 wt. % on the basis of the weight sum of all segments excluding the segment 3.

4. The thermal recording medium according to claim 1, wherein a content of the segment 2 in the polyurethane resin ranges from 0.1 to 50 wt. % on the basis of the weight sum of all segments excluding the segment 3.

5. The thermal recording medium according to claim 1, wherein at least one member selected from the group consisting of polyol and polyamine (hereinafter referred to as "compound 4") is further used as a reacting-component in addition to at least one kind of compound 1, at least one kind of compound 2, and at least one kind of compound 3; and the polyurethane resin comprises at least one segment (hereinafter referred to as "segment 4") derived from at least one kind of compound 4.

6. The thermal recording medium according to claim 5, wherein a content of segment 4 in the polyurethane resin ranges from 1 to 50 wt. % on the basis of the weight sum of all segments excluding the segment 3.

7. The thermal recording medium according to claim 1, wherein at least one kind of compound 5 is further used as a reacting component in addition to at least one kind of compound 1, at least one kind of compound 2, at least one kind of compound 3, and at least one kind of compound 4; and the polyurethane resin contains at least one segment 5.

8. The thermal recording medium according to claim 1, wherein a content of the segment 5 in the polyurethane resin ranges from 1 to 80 wt. % on the basis of the weight sum of all segments excluding the segment 3.

9. The thermal recording medium according to claim 1, wherein the compound 1 is a polymer represented by the following formula:

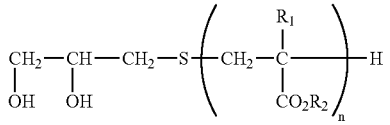

wherein $R_1$ represents a hydrogen atom or methyl group, $R_2$ represents an alkyl group, and n is an integer and a value such that the weight average molecular weight ranges from 1,000 to 20,000.

10. The thermal recording medium according to claim 1, wherein the compound 2 is at least one member selected from the group consisting of dimethylol propanoic acid and dimethylol butanoic acid.

11. The thermal recording medium according to claim 1, wherein the back layer further contains at least one kind of another binder resin.

12. The thermal recording medium according to claim 1, wherein the back layer is crosslinked with the basis sheet by using at least one kind of crosslinking agent.

13. The thermal recording medium according to claim 12, wherein the crosslinking agent comprises at least one member selected from the group consisting of a carbodiimide compound, an organic metal complex compound, a polyisocyanate compound and an epoxy compound.

14. A thermal recording medium comprising a base sheet, a thermal recording layer provided on one side of the base sheet, and a back layer arranged on the opposite side of the base sheet, wherein the back layer comprises as a coating film-forming component a polyurethane resin which is obtained by reacting at least one kind of low-molecular weight polymer (hereinafter referred to as "compound 1") having at least one active-hydrogen- containing group at one end of the molecule, and at least one kind of compound (hereinafter referred to as "compound 2") having at least one active-hydrogen-containing group and at least one hydrophilic group except a hydroxyl group, with at least one kind of polyisocyanate (hereinafter referred to as "compound 3");

wherein at least one segment (hereinafter referred to as "segment 1") is derived from at least one kind of compound 1, at least one another segment (hereinafter referred to as "segment 2") derived from at least one kind of compound 2, and at least one further another segment (hereinafter referred to as "segment 3") derived from at least one kind of compound 3; and wherein the compound 1 is a polymer represented by the following formula:

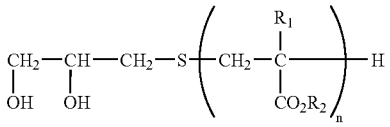

wherein $R_1$ represents a hydrogen atom or methyl group, $R_2$ represents an alkyl group, and n is an integer and a value such that the weight average molecular weight ranges from 1,000 to 20,000.

15. The thermal recording medium according to claim 14, wherein at least one kind of compound 1, at least one kind of compound 2 and at least one kind of compound 3 are reacted at an equivalent ratio of "the equivalent sum of all active-hydrogen-containing groups of the compound 1 and compound 2"/"the equivalent sum of all NCO groups of the compound 3" of from 0.95 to 1.05.

16. The thermal recording medium according to claim 14, wherein a content of the segment 1 in the polyurethane resin ranges from 10 to 95 wt. % on the basis of the weight sum of all segments excluding the segment 3.

17. The thermal recording medium according to claim 14, wherein a content of the segment 2 in the polyurethane resin ranges from 0.1 to 50 wt. % on the basis of the weight sum of all segments excluding the segment 3.

18. The thermal recording medium according to claim 14, wherein at least one member selected from the group consisting of polyol and polyamine (hereinafter referred to as "compound 4") is further used as a reacting-component in addition to at least one kind of compound 1, at least one kind of compound 2, and at least one kind of compound 3; and the polyurethane resin comprises at least one segment (hereinafter referred to as "segment 4") derived from at least one kind of compound 4.

19. The thermal recording medium according to claim 18, wherein a content of segment 4 in the polyurethane resin ranges from ito 50 wt. % on the basis of the weight sum of all segments excluding the segment 3.

20. The thermal recording medium according to claim 14, wherein at least one kind of polysiloxane compound (hereinafter referred to as "compound 5") having at least one active-hydrogen-containing group is further used as a reacting-component in addition to at least one kind of compound 1, at least one kind of compound 2 and at least one kind of compound 3; and the polyurethane resin comprises at least one segment (hereinafter referred to as "segment 5") derived from at least one kind of compound 5.

21. The thermal recording medium according to claim 20, wherein at least one kind of compound 5 is further used as a reacting component in addition to at least one kind of compound 1, at least one kind of compound 2, at least one kind of compound 3, and at least one kind of compound 4; and the polyurethane resin contains at least one segment 5.

22. The thermal recording medium according to claim 21, wherein a content of the segment 5 in the polyurethane resin ranges from 1 to 80 wt. % on the basis of the weight sum of all segments excluding the segment 3.

23. A thermal recording medium comprising a base sheet, a thermal recording layer provided on one side of the base sheet, and a back layer arranged on the opposite side of the base sheet, wherein the back layer comprises as a coating film-forming component a polyurethane resin which is obtained by reacting at least one kind of low-molecular weight polymer (hereinafter referred to as "compound 1") having at least one active-hydrogen- containing group at one end of the molecule, and at least one kind of compound (hereinafter referred to as "compound 2") having at least one active-hydrogen-containing group and at least one hydrophilic group except a hydroxyl group, with at least one kind of polyisocyanate (hereinafter referred to as "compound 3");

wherein at least one segment (hereinafter referred to as "segment 1") is derived from at least one kind of compound 1, at least one another segment (hereinafter referred to as "segment 2") derived from at least one kind of compound 2, and at least one further another segment (hereinafter referred to as "segment 3") derived from at least one kind of compound 3; and wherein the back layer is crosslinked with the basis sheet by using at least one kind of crosslinking agent.

24. The thermal recording medium according to claim 23, wherein the crosslinking agent comprises at least one member selected from the group consisting of a carbodjimide compound, an organic metal complex compound, a polyisocyanate compound and an epoxy compound.

25. The thermal recording medium according to claim 23, wherein at least one kind of compound 1, at least one kind of compound 2 and at least one kind of compound 3 are reacted at an equivalent ratio of "the equivalent sum of all active-hydrogen-containing groups of the compound 1 and compound 2"/"the equivalent sum of all NCO groups of the compound 3" of from 0.95 to 1.05.

26. The thermal recording medium according to claim 23, wherein a content of the segment 1 in the polyurethane resin ranges from 10 to 95 wt. % on the basis of the weight sum of all segments excluding the segment 3.

27. The thermal recording medium according to claim 23, wherein a content of the segment 2 in the polyurethane resin ranges from 0.1 to 50 wt. % on the basis of the weight sum of all segments excluding the segment 3.

28. The thermal recording medium according to claim 23, wherein at least one member selected from the group consisting of polyol and polyamine (hereinafter referred to as "compound 4") is further used as a reacting-component in addition to at least one kind of compound 1, at least one kind of compound 2, and at least one kind of compound 3; and the polyurethane resin comprises at least one segment (hereinafter referred to as "segment 4") derived from at least one kind of compound 4.

29. The thermal recording medium according to claim 28, wherein a content of segment 4 in the polyurethane resin ranges from 1 to 50 wt. % on the basis of the weight sum of all segments excluding the segment 3.

30. The thermal recording medium according to claim 23, wherein at least one kind of polysiloxane compound (hereinafter referred to as "compound 5") having at least one active-hydrogen-containing group is further used as a reacting-component in addition to at least one kind of compound 4, at least one kind of compound 2 and at least one kind of compound 3; and the polyurethane resin comprises at least one segment (hereinafter referred to as "segment 5") derived from at least one kind of compound 5.

31. The thermal recording medium according to claim 30, wherein at least one kind of compound 5 is further used as a reacting component in addition to at least one kind of compound 1, at least one kind of compound 2, at least one kind of compound 3, and at least one kind of compound 4; and the polyurethane resin contains at least one segment 5.

32. The thermal recording medium according to claim 31, wherein a content of the segment 5 in the polyurethane resin ranges from 1 to 80 wt. % on the basis of the weight sum of all segments excluding the segment 3.

33. The thermal recording medium according to claim 23, wherein the compound 1 is a polymer represented by the following formula:

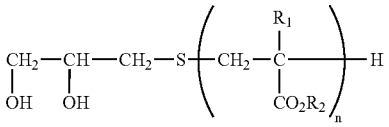

wherein $R_1$ represents a hydrogen atom or methyl group, $R_2$ represents an alkyl group, and n is an integer and a value such that the weight average molecular weight ranges from 1,000 to 20,000.

34. The thermal recording medium according to claim 23, wherein the compound 2 is at least one member selected from the group consisting of dimethylol propanoic acid and dimethylol butanoic acid.

35. The thermal recording medium according to claim 23, wherein the back layer further comprises at least one kind of another binder resin.

* * * * *